United States Patent [19]

Piel

[11] 4,017,926

[45] Apr. 19, 1977

[54] LIFE-SAVING GARMENT

[75] Inventor: Michel Piel, Etampes, France

[73] Assignee: Societe Industrielles des Establissements Piel, Etampes, France

[22] Filed: July 14, 1975

[21] Appl. No.: 595,794

[52] U.S. Cl. ..... 9/331; 9/338

[51] Int. Cl.[2] ..... B63C 9/12

[58] Field of Search ..... 9/329–333, 9/336, 338, 337

[56] References Cited

UNITED STATES PATENTS

| | | | |
|---|---|---|---|
| 1,065,017 | 6/1913 | Aud | 9/331 |
| 1,066,516 | 7/1913 | Moore | 9/330 |
| 1,901,859 | 3/1933 | Anderson | 9/332 |
| 2,728,916 | 1/1956 | Clarke et al. | 9/331 |
| 2,761,154 | 9/1956 | Horiuchi | 9/331 |
| 2,782,430 | 2/1957 | Radnofsky | 9/332 |

FOREIGN PATENTS OR APPLICATIONS

| | | | |
|---|---|---|---|
| 219,922 | 3/1958 | Australia | 9/329 |
| 4,596 | 5/1896 | United Kingdom | 9/332 |

*Primary Examiner*—Trygve M. Blix
*Assistant Examiner*—Stuart M. Goldstein
*Attorney, Agent, or Firm*—Donald D. Jeffery

[57] ABSTRACT

A life-saving garment for a person in water comprising a capacious sack integrally formed with legs, sleeves and a hood and open at one end to permit entry by the wearer. An inflatable pocket is hinged at its upper edge to the exterior of the front portion of the garment so as to be swingable about an axis substantially parallel to the line of the shoulders of the wearer, whereby the pocket when inflated can swing to a position keeping the head of the wearer above water regardless of the position of the wearer in the water.

14 Claims, 7 Drawing Figures

LIFE-SAVING GARMENT

The present invention relates to life-saving garments for preventing their wearers from drowning.

A known kind of life-saving garment includes a buoy positioned so as to be located on the chest of a wearer to keep the wearer in a position in which his body faces upwards when in the water. It is normally intended that the person in the water, if not initially occupying this position, e.g. being face downwards, should be able to turn over by moving his legs so as to take up the required position which he or she then maintains due to the presence of the buoy.

It is an object of the present invention to improve a life-saving garment provided with a flotation means whereby the flotation means will always keep the head of the wearer of the garment out of the water, whatever the position of the wearer, while enabling the wearer to turn over more readily if he or she is initially facing downwards.

Accordingly the present invention provides a life-saving garment for a person in water, including a front portion adapted to be worn on the person's chest, and flotation means mounted on the exterior of said front portion so as to be swingable about an axis substantially parallel to the line of the person's shoulders and located below the armpits.

In a preferred arrangement, an upper edge of the flotation means is secured on the front of the garment to define a hinge axis about which the flotation means is swingable.

The flotation means preferably comprises an inflatable pockets of substantially rectangular shape, an upper edge of which, when the pocket is flat upon the front portion of the garment, is arranged to extend substantially across the sternum of a wearer of the garment while a lower edge of the pocket is arranged to extend substantially across the wearer's groin.

The lateral edges of the pocket are suitably located on the front of the garment and may, for example, be positioned substantially opposite the joints between the sleeves and the garment.

It is also an object of this invention to provide a life-saving garment which as well as protecting its wearer from drowning, will protect its wearer from cold and thus it may be particularly suitable for use by shipwrecked persons.

Diving garments are already known which comprise a one-piece suit of flexible water-proof and thermally insulating material and which have legs, sleeves and a hood, with, in some cases, boots and gloves forming extensions of the legs and sleeves respectively. For protecting a wearer from cold, the life-saving garment of this invention may, in a preferred form, comprise an adaptation of such a suit though it will be appreciated from the following that this adaptation is such that the life-saving garment to which the invention relates could in no way be used as a diving suit just as a diving suit cannot form a life-saving garment.

To provide a life-saving garment which will protect its wearer from cold and from drowning, the garment preferably is made of flexible water proof thermally insulating material, includes legs, sleeves and a hood, and has the general form of a capacious sack which includes the front portion on which the flotation means is mounted, and the sack extends along a longitudinal axis from a lower end which is shaped to define the legs, to an upper end which is completely open and which comprises the entry opening permitting entry into and outlet from the sack, said longitudinal axis passing through a median zone where the sack is provided with exterior pockets which merge with the sack, and two of said pockets forming the sleeves and one the hood.

The preferred life-saving garment is a capacious sack into which a person can get while completely clothed and wearing shoes or boots, and thus differs from the known diving suit which is a specially adapted garment which requires the user to undress, usually completely, and to remove his footwear before putting on the suit.

A further difference between the known diving suit and the preferred life-saving garment of the present invention is that the entry opening of the latter is located about the hood whereas the known diving suits usually have an opening in the form of slot extending along a line located below the hood.

Furthermore, the line along which the opening of known diving suits extends usually follows a complicated non-rectilinear path, whereas the line along which the opening of the preferred life-saving garment runs can be a simple straight line running a right angles to the general length of the sack. This line of the opening can also be substantially parallel to the shoulder-line extending over the distance between the tops of the sleeves.

The sack constituting the life-saving garment is preferably of general cylindrical shape, the axis of the cylinder defining the longitudinal axis of the garment. The legs may thus form extensions at the base of the cylinder, with the sleeves and the hood comprising attachments projecting from the cylinder.

It is to be understood, however, that the word "cylinder" is intended also to cover substantially cylindrical shapes and frusto-conical shapes.

Preferably, the legs are closed and have free ends shaped in the form of feet, and the sleeves are also closed with their free ends in the form of gloves.

In one preferred arrangement, the entry opening of the life-saving garment is formed by two lips which can be applied against each other to close the sack and at least one of the lips is provided with a respective reinforcing element enabling an upper flat part of the sack located above a zone where the hood begins, to be rolled over upon itself around the reinforcing elements without forming creases along the length of the opening, and in such manner as to form a roll immediately above said zone where the hood begins, said roll being adapted then to be looped around the neck of the wearer.

An example of a life-saving garment embodying the invention is illustrated in the accompanying drawings. In the drawings.

Figure 2:
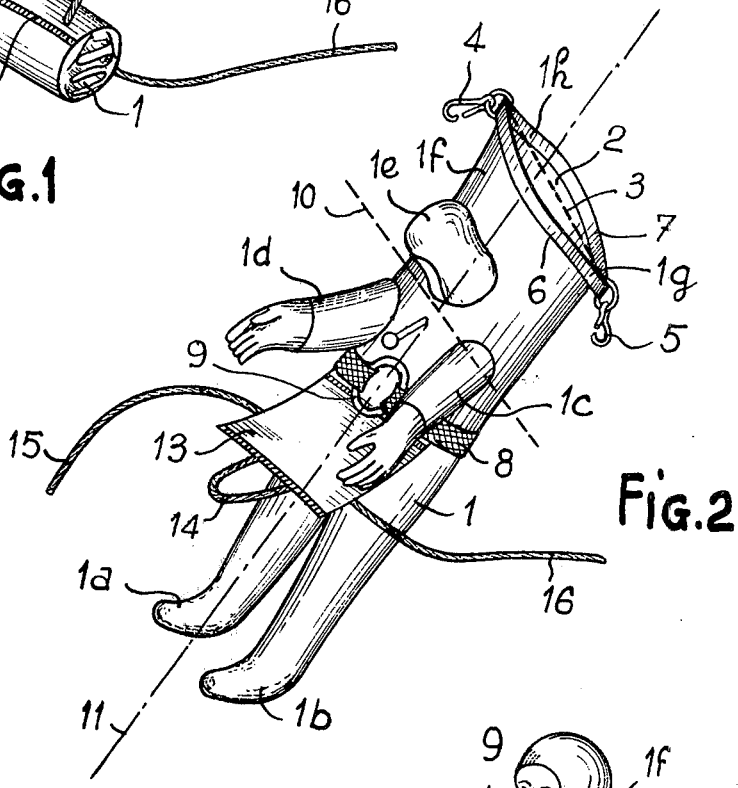
FIG. 2 shows the garment when unrolled but does not show the flotation means which is secured under the apron.
Figure 4:
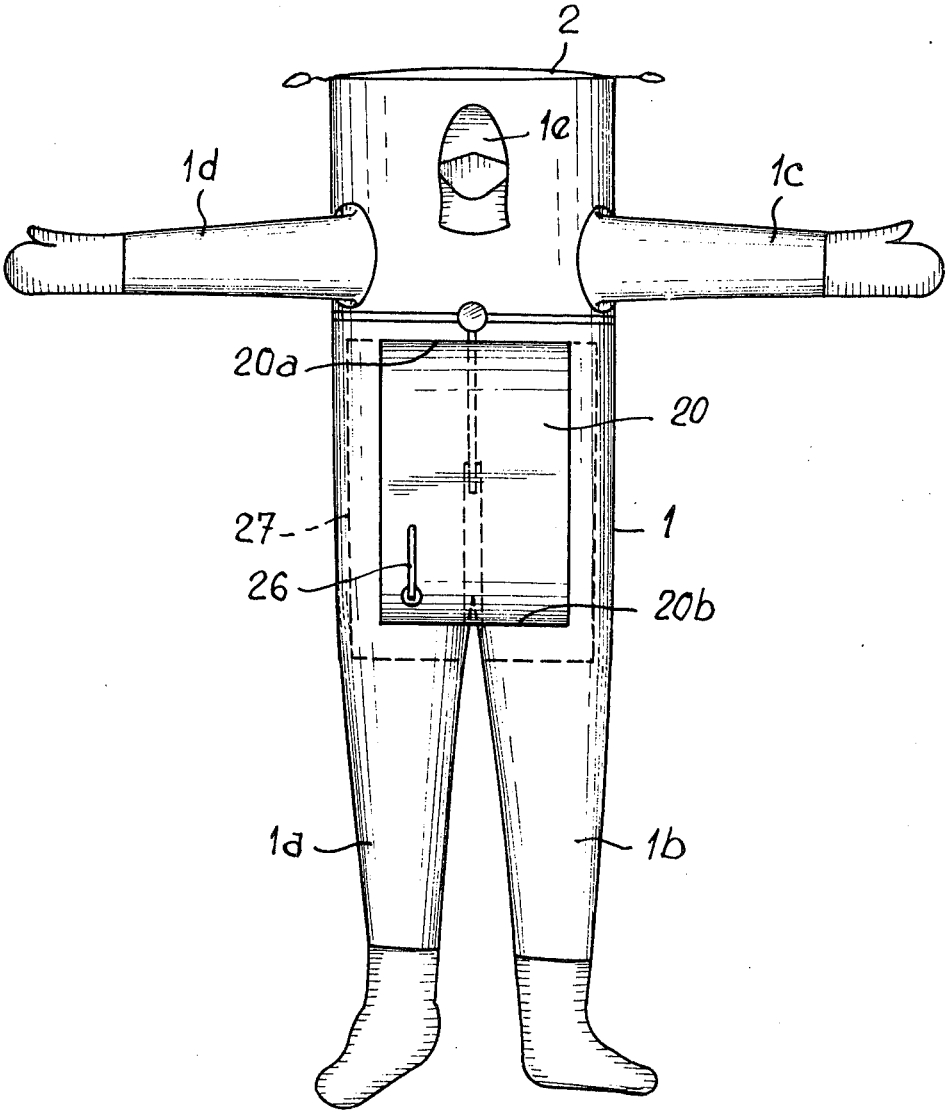
FIG. 4 is a view of the garment flattened out, showing also the essential flotation means (in this instance, a buoyancy bag) and showing the apron in broken lines though the apron does in fact lie on top of the buoyancy bag.

The life saving garment shown in the drawings will now be more particularly described firstly with reference to FIGS. 2 and 4. The garment shown comprises a capacious sack 1 of generally cylindrical form which has a longitudinal axis 11. The sack has an entry opening 2 at its upper end which permits a wearer to enter or leave the garment, and the base of the cylinder at the lower and of the garment is provided with extensions shaped to define right and left legs 1*a* and 1*b* respectively with closed free ends shaped in the form of feet. At a median zone the sack 1 is provided with three outwardly protecting pockets 1*c*, 1*d* and 1*e* which define, respectively, left and right arms and a hood which all merge with the sack. The arms 1*c* and 1*d* have closed ends shaped in the form of gloves.

The sack 1 of the garment can be laid substantially flat along a plane containing the longitudinal axis 11 of the garment, with the exception of the parts of the garment which project from this plane, such as the hood 1*e* for example.

When the garment is laid flat, its entry opening, which is circular when the sack is cylindrical, extends along diameter of the circle at right-angles to the axis of the cylinder.

The hood 1*e* of the garment is similar to that of known diving suits, i.e. it is a hood adapted to cover the head of a wearer and which only leaves the face uncovered. The hood lies closely against the rest of the head so that it does not form an opening through which water can enter the garment.

Attached to the exterior of the front portion of the sack 1 which is adapted to cover a wearer's chest is a flotation means in the form of a buoyancy bag 20 (not shown in FIG. 2 but shown in FIG. 4). The buoyancy bag 20 is of substantially rectangular shape and is secured to the sack 1 at an upper edge 20*a* by any suitable means such as welding, bonding, stitching etc. (depending upon the nature of the materials of which the life-saving garment is made) so as to be swingable about an axis substantially parallel to the line 10 of a wearer's shoulders but below the armpits. The upper edge 20*a* thus substantially comprises a hinge axis for the swingable buoyancy bag.

Figure 5:
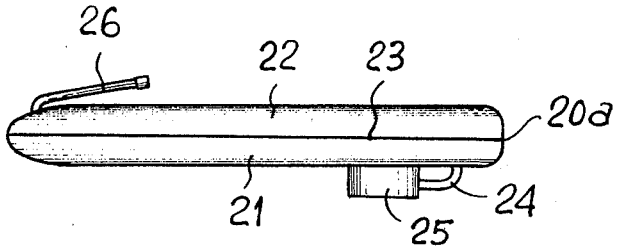
FIG. 5 is a longitudinal section through the flotation means.

The buoyancy bag is a generally rectangular pocket structure and is shown in greater detail in FIG. 5. As shown, the pocket structure comprises two juxtaposed compartments 21 and 22 which do not communicate with each other and which each extend over the entire length of the pocket but are separated by a flexible membrane 23 adapted to be laid flat against a lower or upper wall of the pocket. One of the compartments is adapted to be connected through a suitable tube 24 to a gas source 25 or any other automatic inflation means, and the other compartment is provided with a tube 26 which enables it to be inflated by the wearer of the garment blowing into said compartment. If the automatic inflation means should fail, the pocket can thus be inflated by the person in the water. It should be mentioned that this structure also provides safety with regard to possible perforation of the wall of the bag, since one of the compartments remains water-tight. The gas source 25 may be secured to the buoyancy bag.

A high strength strap 8 joined at the front portion of the sack 1 by a ring 9 positioned to lie against the chest of a wearer on the longitudinal axis of the garment surrounds the sack 1 below the armpits for use in hoisting a wearer from the water.

Above the median zone of the sack 1 there is an upper part 1*f* of the sack which terminates at the entry opening 2 at the uppermost end of the sack. As will be seen from the drawings, the entry opening is surrounded by two opposed lips 1*g* and 1*h* which can be pressed together along a line 3 (FIG. 2) to close the top of the sack 1.

At least one of the lips, and in the embodiment shown, each of the lips 1*g* and 1*h* is provided with a respective reinforcing element 7 and 6. The reinforcing elements are each narrow elongate strips of whalebone or other material having similar mechanical properties, and have a high degree of rigidity in one transverse direction and a minimum of longitudinal flexibility to enable them to be bent into a loop. Leaf springs or equivalent strips in synthetic plastics material would thus be suitable.

The opening 2 is preferably provided with a closure means (not shown in the example illustrated) at the lips 1*g*, 1*h* and the lips are positioned opposite one another to be pressed against one another and retained by the closure means. The reinforcing elements do not however, extend right to the corners of the lips and thus they do not prevent flattening out of the upper part of the sack. The closure means suitably comprises a slide fastener, buttons, or an interlocking system of the "Velcro" type. Alternatively, however, the closure means may be water-tight, for example a water tight slide fastener, but this is generally less satisfactory and may cause trouble.

Figure 3:
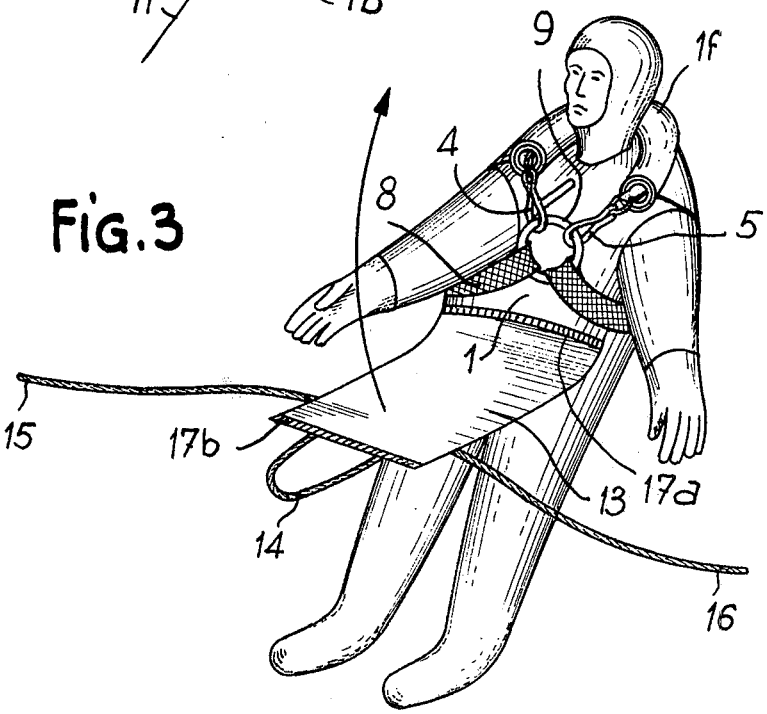
FIG. 3 shows the garment of FIG. 2 in use.

As will be seen in FIG. 3 which shows the garment being worn, the upper part 1*f* of the sack can be rolled down upon itself around an axis parallel to the length of the opening 2 and to the shoulder line 10. The reinforcing elements elements 6, 7 serve as a core for the roll and prevent creases being formed along the length of the opening 2. The fully rolled upper part 1*f* will lie immediately above the zone where the hood begins and because the reinforcing elements are bendable in one direction, the whole roll can be looped around the neck of the wearer (see FIG. 3) to serve as a collar and as a float around the wearer's neck to increase the wearer's stability in the sea.

In order to retain the loop in position, two releasable clasps 4, 5 are secured to the corners of the lips 1*g*, 1*h* on the exterior of the sack where they adjoin one another. The clasps could however, alternatively be fitted at some other place on the upper part 1*f* of the sack such as the lateral edges and could suitably comprise alternative means such as a hook and a ring. The clasps 4, 5 can be hooked together in front of the wearer's chest or onto the ring 9 on the front of the garment, and when the latter is the case, the loop formed by the rolled upper part 1*b* of the sack will act in conjunction with the strap 8 to support the wearer when the wearer is hoisted by means engaging the hoisting ring 9. When the loop is secured in position by the clasps 4, 5, the roll cannot become undone accidentally because of the presence of the reinforcing elements and the opening 2 which has been rolled and looped will thus be rendered watertight whether or not water tight closure means are employed.

Figure 6:
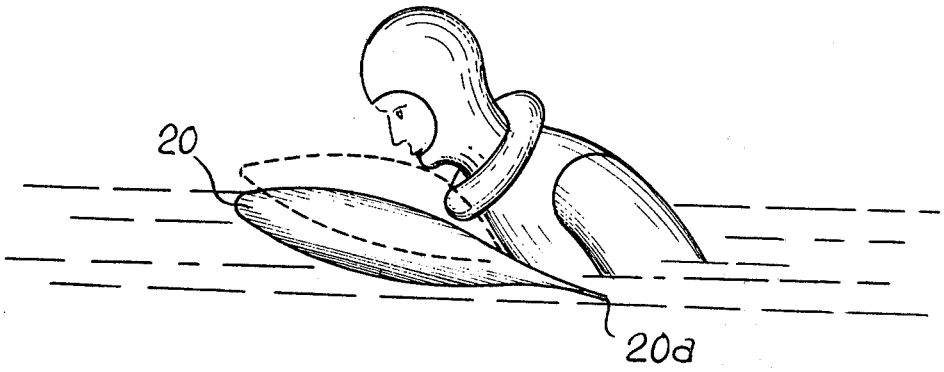
FIG. 6 is a diagrammatic partial view of a person, face downwards, in the water wearing the garment.
Figure 7:
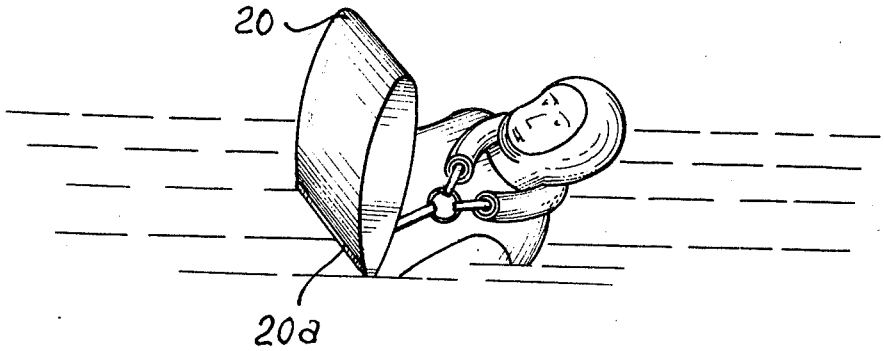
FIG. 7 is a diagrammatic partial view of a person in the water, face upwards, wearing the garment.

Except for being connected to the garment by its upper edge 20*a* and preferably also to an automatic inflation means, the buoyancy bag is completely free to swing so that when the wearer of the garment is in the water, the pocket can be swung back through approximately 180° about its upper edge (FIG. 6) into a position in front of the face of the person, in which position it forms a cushion which keeps the head of the person out of the water when the person is facing downwards. Alternatively the pocket can be brought into a vertical position after being swung through approximately 90° about its upper edge (FIG. 7).

The illustrated garment is designed to give a positive buoyancy of 12 to 15 kilogrammes.

The pocket may suitably have a capacity of 12 to 15 liters, is located on the front of the sack but is only secured thereto by its upper edge 20*a*.

The buoyancy bag may suitably extend over a length of approximately 50 to 60 centimeters from the line 20*a*, immediately below the armpits of the garment to a line 20*b* situated just below the crotch.

The capacity of the pocket is such that even when partially inflated it contains at least 10 liters of gas.

Located exterior of the buoyancy bag 20 is a rectangular apron 13 secured only at an upper edge to the front portion of the sack 1 jointly with the buoyancy bag 20 to overlie the buoyancy bag. Although the apron is shown in dashed lines at 27 in FIG. 4, the apron as just noted overlies the bag 20.

Figure 1:
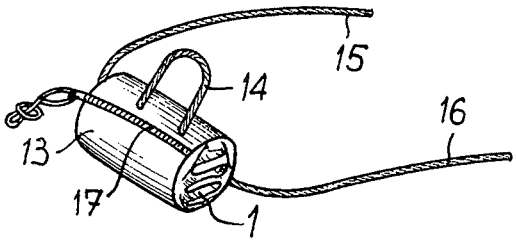
FIG. 1 shows the garment rolled up in an integral apron (for storage)

The apron is suitably brightly coloured e.g. orange, to serve as a visual marker when a wearer of the garment is in the sea, and has a width equal to the sack 1 when the latter is flattened out, and a length just differential to surround the remainder of the garment when the latter is tightly rolled up upon itself from top to bottom or vice versa about an axis transverse to the axis 11, (see FIG. 1).

The position at which the apron 13 is secured to the front of the sack 1 is selected so that:

- when a person wearing the garment is floating in the normal manner, the apron 13 forms a luminous patch floating on the surface of the water visible from above,
- the person in the water can bring the apron 13 into a vertical position to enable it to be seen more easily along a horizontal line, and
- the person in the water can pull the apron 13 down on to his face to protect it from spray or rain for example.

The apron 13 may also carry marks identifying the garment.

By providing the upper end and lower ends of the apron 13 with means 17*a*, 17*b* adapted to co-operate with each other to secure the two ends together (for example one half of a slide fastener at each end), the apron 13 can form a sleeve which encloses the remainder of the garment when the later is tightly rolled on to itself as already described.

Furthermore, the apron is provided with a neck halter 14 which also forms a handle for carrying the said sleeve and two lateral straps 15, 16 adapted to form a belt.

With these attachments provided, the garment rolled up in its apron serves as a folded life-jacket.

A whistle may be attached by a hook to the garment to complete the equipment so that it complies with any existing regulations.

The sack is made for example of cellular neoprene or other flexible, water-proof and thermally insulating material having positive buoyancy.

Prior to use, the garment has the appearance of a life-jacket as seen in FIG. 1. When the garment is to be used, the person requiring it undoes the closure means 17 of the apron and unfolds the sack (FIG. 2).

He gets into the sack through the opening 2, brings his legs and arms into position and puts on the hood.

He then grips the hooks 4 and 5 to stretch out the part 1*f*, folds this part on to itself to form a roll, and loops the roll around his neck. He then secures the hooks to the ring 9 (FIG. 3).

This completes the necessary operations. It will be seen that the generous size of the sack enables the person in the water to move in the interior of the sack.

Whilst the invention has now been particularly described, it is to be understood that the invention also includes any improvements or modifications that may be made within the scope of the appended claims.

I claim:

1. A life-saving garment for a person in water, including a front portion adapted to be worn on the person's chest, and an inflatable pocket of substantially rectangular shape located on the exterior of said front portion, said pocket being secured to said front portion of the garment at an upper edge of said pocket, which edge defines the hinge axis of said pocket, the pocket being swingable about an axis substantially parallel to the line of the person's shoulders and located below the armpits, said garment being made of flexible, waterproof, thermally insulating material and including legs, sleeves and a hood, the garment having the general form of a capacious sack which includes said front portion and extends along a longitudinal axis from a lower end, which is shaped to define the legs, to an upper end, which is completely open and which comprises the entry opening permitting entry into and out from the sack, said longitudinal axis passing through a medium zone where the sack is provided with exterior pockets which merge with the sack, two of said projecting pockets forming the sleeves and one the hood, said open end of the sack defining, when the garment is laid flat, a straight line substantially at right angles to the longitudinal axis of the sack and substantially parallel to a shoulder line extending between points where the sleeves begin, said entry opening being defined by two lips which can be applied to each other to close the sack, with at least one of said lips being provided with a reinforming element enabling an upper flat part of the sack located above a zone where the hood begins to be rolled over upon itself around the reinforcing element without forming creases along the length of the opening in such manner as to form a roll immediately above said zone where the hood begins, said roll being adapted then to be looped around the neck of a wearer.

2. A life-saving garment as claimed in claim 1 wherein said pocket includes two inflatable juxtaposed compartments which do not communicate with each other and are separated by a flexible membrane, each of the compartments being provided with connecting means to inflation means.

3. A life-saving garment as claimed in claim 1 in which said inflatable pocket has an upper edge which, when the pocket is laid flat upon said front portion of the garment, is arranged to extend substantially across the sternum of a wearer of the garment, while a lower edge of the pocket is arranged to extent substantially across the groin of the wearer.

4. A life-saving garment as claimed in claim 1 in which said inflatable pocket has a capacity between 12 and 15 liters.

5. A life-saving garment as claimed in claim 1 in which said sack is of generally cylindrical form, the axis of the cylinder being the longitudinal axis of the garment.

6. A life-saving garment as claimed in claim 1 in which said legs are closed and have ends shaped in the form of feet.

7. A life-saving garment as claimed in claim 1 in which each of said lips is provided wit a reinforcing element in the form of elongate means having high transverse rigidity and a minimum of longitudinal flexibility, said elongate means not extending to the point where said lips are adapted to join each other, said reinforcing elements permitting the upper end of said sack to be rolled and looped upon itself in a direction toward said shoulder line.

8. A life-sving garment as claimed in claim 7 in which said lips include closure means which ensures that both lips are positioned opposite each other to enable them to be applied to each other in co-operation with the reinforcing elements.

9. A life-saving garment as claimed in claim 7 further including means for maintaining said looping of said upper flat part of the sack.

10. A life-saving garment as claimed in claim 9 in which said loop maintaining means comprise clasps secured to the corners of said lips, said clasps being secured to a ring.

11. A life-saving garment as claimed in claim 10 in which the sack has on its exterior, around the chest at the level of the armpits, a support strap, the ends of which strap are secured to said ring which is positioned on the longitudinal axis of the garment extending along the chest for enabling a person in the water to be hoisted.

12. A life-saving garment as claimed in claim 1 further including a brightly colored marker apron secured on said garment exteriorly of said inflatable pocket, sid apron having a width corresponding to that of the garment when laid out flat, and a length corresponding to that of the garment when the latter is rolled tightly upon itself from top to bottom or vice versa, said apron being attached to the garment only along a line which forms the upper edge of the apron and extending substantially horizontally across the chest of a wearer of the garment.

13. A life-saving garment as claimed in claim 12 in which the apron is provided at its upper end and at its lower end with cooperative fastener means for securing said two ends in order that the apron may form a sleeve surrounding said garment when the latter is tightly rolled upon itself.

14. A life-saving garment as claimed in claim 12 in which the apron is provided with a halter which forms a handle for carrying the garment and with two lateral straps.

* * * * *